US007487728B2

(12) United States Patent
Cranor

(10) Patent No.: US 7,487,728 B2
(45) Date of Patent: Feb. 10, 2009

(54) SMALL CALIBER CHEMILUMINESCENT MUNITIONS

(75) Inventor: Earl Cranor, Longmeadow, MA (US)

(73) Assignee: Cyalume Technologies, Inc., West Springfield, MA (US)

( * ) Notice: Subject to any disclaimer, the term of this patent is extended or adjusted under 35 U.S.C. 154(b) by 0 days.

(21) Appl. No.: 11/689,894

(22) Filed: Mar. 22, 2007

(65) Prior Publication Data

US 2008/0229964 A1 Sep. 25, 2008

(51) Int. Cl.
*F42B 8/12* (2006.01)
*F42B 12/40* (2006.01)

(52) U.S. Cl. ..... 102/513; 102/529; 362/34

(58) Field of Classification Search ..... 102/513, 102/529, 444, 445, 498, 501, 502; 362/34
See application file for complete search history.

(56) References Cited

U.S. PATENT DOCUMENTS

| | | | | |
|---|---|---|---|---|
| 3,391,069 | A | 7/1968 | Rauhut et al. | |
| 3,539,794 | A | 11/1970 | Rauhut et al. | |
| 3,557,233 | A | 1/1971 | Zweig et al. | |
| 3,597,362 | A | 8/1971 | Bollyky et al. | |
| 3,745,324 | A | 7/1973 | Shefler et al. | |
| 3,749,620 | A | 7/1973 | Montgomery | |
| 3,749,679 | A | 7/1973 | Rauhut | |
| 3,775,336 | A | 11/1973 | Kasulin et al. | |
| 3,808,414 | A | 4/1974 | Roberts | |
| 3,888,786 | A | 6/1975 | Maulding | |
| 3,893,938 | A | 7/1975 | Rauhut | |
| 3,940,605 | A | 2/1976 | Gerber | |
| 3,974,368 | A | 8/1976 | Rauhut | |
| 4,553,481 | A | 11/1985 | Ricci | |
| 4,635,166 | A | 1/1987 | Cameron | |
| 4,640,193 | A | 2/1987 | Koroscil | |
| 4,682,544 | A | 7/1987 | Koroscil et al. | |
| 4,814,949 | A | 3/1989 | Elliott | |
| 5,018,450 | A * | 5/1991 | Smith | 102/513 |
| 5,018,540 | A | 5/1991 | Grubbs et al. | |
| 5,035,183 | A | 7/1991 | Luxton | |
| 5,121,302 | A | 6/1992 | Bay et al. | |
| 5,359,937 | A | 11/1994 | Dittrich | |
| 5,488,544 | A * | 1/1996 | Ladyjensky | 362/34 |
| 5,492,063 | A | 2/1996 | Dittrich | |
| 5,508,893 | A * | 4/1996 | Nowak et al. | 362/34 |
| 5,546,863 | A | 8/1996 | Joslyn | |
| 5,552,968 | A * | 9/1996 | Ladyjensky | 362/34 |
| 5,661,257 | A | 8/1997 | Nielson et al. | |
| 6,497,181 | B1 * | 12/2002 | Manole et al. | 102/513 |
| 6,619,211 | B1 * | 9/2003 | Haeselich | 102/513 |
| 6,931,993 | B1 * | 8/2005 | Manole et al. | 102/458 |
| 6,990,905 | B1 * | 1/2006 | Manole et al. | 102/513 |
| RE40,482 | E * | 9/2008 | Haeselich | 102/513 |
| 2002/0134274 | A1 * | 9/2002 | Martinez et al. | 102/513 |
| 2006/0032393 | A1 * | 2/2006 | Haeselich | 102/502 |

(Continued)

*Primary Examiner*—James S Bergin
(74) *Attorney, Agent, or Firm*—McHale & Slavin, P.A.

(57) ABSTRACT

The present invention relates to the field of training military, law enforcement personnel, or the like, tasked with the accurate firing of small caliber munitions. A need exists for quantifying the ability of the trainees by detecting the accuracy with which they are able to strike their intended targets, especially in nighttime training situations. This invention relates to munitions which contain a chemical light producing system; particularly to small caliber munitions containing a chemiluminescent chemical light system; and most particularly to small caliber munitions having selectable, marking, tracing, or combined tracing/marking utility.

9 Claims, 1 Drawing Sheet

U.S. PATENT DOCUMENTS

2007/0119329 A1* 5/2007 Haeselich ..... 102/498
2008/0035006 A1* 2/2008 Ciesiun et al. ..... 102/513
2008/0053330 A1* 3/2008 Haeselich ..... 102/513

* cited by examiner

SMALL CALIBER CHEMILUMINESCENT MUNITIONS

FIELD OF THE INVENTION

This invention relates to munitions which contain a chemical light producing system; particularly to small caliber munitions containing a chemiluminescent chemical light system; and most particularly to small caliber munitions having selectable, marking, tracing, or combined tracing/marking utility.

BACKGROUND OF THE INVENTION

In the training of military and law enforcement personnel tasked with the accurate firing of small caliber munitions, a need exists for quantifying the ability of the trainees by detecting the accuracy with which they are able to strike their intended targets. This is important not only for personnel training, but also to determine the effectiveness of various equipment systems, and as a means of calibrating such systems.

Various devices are currently employed for marking the ultimate destination of projectiles. The most used devices are pyrotechnics which produce a flash of light and a puff of smoke to indicate the site of projectile impact. One such device employs titanium tetrachloride which produces a cloud of smoke when it reacts with the moisture in the air on impact. A second such device is a red phosphorus bearing projectile which emits a flash of light upon impact.

Such devices have inherent problems, not the least of which is that the phosphorus device generates light by burning and, as a result, many items with which the burning phosphorus comes into contact also burn i.e. trees, shrubs; grass etc.; while the titanium tetrachloride devices, because they only emit smoke, are practically useless for nighttime detection.

Devices are also known which are useful for both day and night practice and do not function by burning i.e. they are cold, and therefore are free from the disadvantages attendant incendiary devices. They provide non-pyrophoric chemical light illumination as a spray of light which can be, for example, blue, yellow or green. These devices also provide a secondary benefit in that they form colored smoke which can be detected in daylight. Such devices generally comprise a hollow container adapted for insertion into a device for use in creating a signal and having fitted into the hollow space or interior thereof, (a) a fuse or percussion cap, (b) a propellant, (c) a chemiluminescent light activator solution, (d) a chemiluminescent light fluorescer solution, (e) a non-reactive enhancer capable of absorbing or adsorbing the reaction product produced upon contact of (c) and (d) which occurs upon detonation of said fuse or cap, and (f) a sealing means.

In many cases, military forces training on gunnery accuracy in larger calibers (40 mm to 155 mm) often desire to train with non-explosive ammunition. This desire may stem from safety concerns, use of public lands for training (Europe), desire to not cause wild-fires in the training area (Western USA in Summer months). Non-explosive ammunition that marks has been developed to meet this need. This ammunition usually contains a colored liquid or a colored powder. When the ammunition impacts the target area, the ammunition distorts (usually fragments) and releases the colored liquid or powder, marking the impact area. This marking allows feedback to the gunner and can be used to improve training on accuracy without causing excessive destruction or any other problems in the impact area.

A need exists for a non-explosive training round which safely exhibits nighttime visibility.

DESCRIPTION OF THE PRIOR ART

U.S. Pat. No. 3,940,605 is drawn to a chemiluminescent lighting apparatus for generating an illuminated marker material for delivery to a desired area. Two fluids to be mixed are contained in separate chambers and are separated from a mixing chamber by means of frangible disc-shaped members. A hollow gas generator expels gas when a squib fractures one of its walls. The force of the escaping gas exerts pressure on the two fluids sufficient to fracture the frangible disc members allowing mixing action in the mixing chamber. The mixed fluid chemically reacts to produce light and flows from the mixing chamber to a light transmittable material where it is stored to provide an illuminated area.

U.S. Pat. No. 4,553,481 is drawn toward a molded plastic wad for use in a shotgun shell having a primer propellant and shot. The device comprises an upper, generally cylindrical shot compartment for receiving and holding the shot and a lower, generally enclosed chamber secured to the lower end of the shot compartment proximate the propellant. The lower chamber has side walls and a bottom wall comprised of an overpowder wad. Tracer means are positioned within the lower compartment for forming a chemiluminescent tracer to accompany the shot upon the firing of the shot shell.

U.S. Pat. Nos. 4,640,193 and 4,682,544 teach a container adapted for insertion into a device wherein the container has fitted into its hollow interior the components required to form therein and eject therefrom, upon impact and detonation, a chemiluminescent light emitting material, inclusive of a reactive enhancer.

U.S. Pat. No. 5,018,540 teaches a luminescent paintball which comprises a double chamber projectile capsule that contains two chemical agents which, when mixed together on impact, provide a chemically luminescent spot for marking at night. The chambers are provided with a double barrier which assures necessary shelf life and complete separation of the active ingredients.

U.S. Pat. No. 5,546,863 is drawn towards a line carrying projectile having an axially elongate hollow projectile rod for muzzle loading within the bore of an associated shotgun and an at least partially transparent container assembly mounted on the forward end of the projectile rod and containing a chemiluminescent flare. The flare is removed from the container and activated by bending after which it is reassembled within the container in its active condition preparatory to firing. A part of the projectile frictionally engages and grips an associated portion of the gun barrel to releasably retain the projectile in a launching position within the gun and regardless of barrel orientation until the projectile is fired from the gun.

U.S. Pat. No. 5,661,257 teaches a multispectral covert target marker; described as a covert, i.e., no visible light emitted, multispectral day/night target marker. The marker emits a signature detectable in the electromagnetic spectrum including visible, near infrared, middle and longwave infrared, and radar regions. The marker is particularly useful for marking of target areas so that they can be easily detected from the ground or the air. The visible spectrum is marked by a white or colored pyrotechnic smoke generant. The near infrared region is marked by near infrared emitting photodiodes encased in a hardened polymeric molding compound. These diodes are only visible through night vision devices (image intensifiers). The middle through the far infrared regions are marked by the heat generated from the combustion of the pyrotechnic smoke generant. The smoke generant is housed in a canister having a highly emissive surface. The radar region is marked using radar chaff. The target marker is configured for use with conventional mortar or rocket delivered flare systems. A hand held, rocket-propelled parachute signal is disclosed which includes near infrared emitting photodiodes and oscillator electronics assembly encased in a hardened polymeric molding compound launched from a hand-fired expendable-type launcher.

U.S. Pat. No. 3,745,324, discloses a parachute soaked in a chemiluminescent agent which is dropped to the desired location.

Frangible plastic projectiles have been developed that press fit into the casings of normal service ammunition (as taught in U.S. Pat. No. 5,035,183) or reduced energy cartridges (as taught in U.S. Pat. Nos. 5,359,937 and 5,492,063). These projectiles may then be fired from normal service arms, with conversion kits installed to accept the special ammunition. An example of these plastic projectiles is the SIMUNITION® FX® Marking Cartridge manufactured and sold by SNC Technologies Inc. of Canada. This line of ammunition (ranging from 5.4 mm to .55 calliber) is comprised of a frangible plastic projectile that contains a small amount of colored liquid soap. These projectiles fracture when they strike their intended target and mark the target with the colored soap. This provides a visual clue as to the effectiveness and accuracy of the training.

While the above described plastic training ammunition is suitable for daytime training, it is not effective for nighttime training because the colored liquid soap marking agent is not visible in the dark. Since many police and military situations only occur at night, a significant need for a nighttime training round exists.

SUMMARY OF THE INVENTION

The present invention is directed toward a plastic training bullet constructed and arranged for containment of the necessary components of a chemical light system for the production of light by chemiluminescence. Chemiluminescense relates to the production of visible light attributable to a chemical reaction. The important aqueous chemiluminescence substances luminal and lucigenin were discovered in 1928 and 1935, respectively. A series of organic soluble chemiluminescent materials were developed in the early 1960's based on a study of the luminescent reactions of a number of organic compounds. A typical organic system useful for chemiluminescence was disclosed by Bollyky et al., U.S. Pat. No. 3,597,362 and claimed to exhibit a quantum efficiency of about 23% compared with about 3% for the best known aqueous systems.

In its most basic form the two-component, liquid phase oxalate ester chemical light system must comprise an "oxalate component" comprising an oxalic acid ester and a solvent, and a "peroxide component" comprising hydrogen peroxide and a solvent or mixture of solvents. In addition, an efficient fluorescer must be contained in one of the components. An efficient catalyst, necessary for maximizing intensity and lifetime control, may be contained in one of the components.

The oxalate component provides an oxalate ester-solvent combination which permits suitable ester solubility and storage stability. The peroxide component provides a hydrogen peroxide-solvent combination which permits suitable hydrogen peroxide solubility and storage stability.

The solvents of the two components may be different but must be miscible. At least one solvent solubilizes the efficient fluorescer and at least one of the solvents solubilizes the efficient catalyst.

Typical suitable fluorescent compounds for use in the present invention are those which have spectral emission falling between about 300 and 1200 nanometers and which are at least partially soluble in the diluent employed. Among these are the conjugated polycyclic aromatic compounds having at least 3 fused rings, such as: anthracene, substituted anthracene, benzanthracene, substituted benzanthracene, phenanthrene, substituted phenanthrene, naphthacene, substituted naphthacene, naphthalene, substituted naphthalene, pentacene, substituted pentacene, perylene, substituted perylene, violanthrone, substituted violanthrone, and the like. Typical substituents for all of these are phenyl, alkyl ($C_1$-$C_{16}$), chloro, bromo, cyano, alkoxy ($C_1$-$C_{16}$), and other like substituents which do not interfere with the light generating reaction contemplated herein.

The preferred fluorescers are 9,10-bis(phenylethynyl) anthracene, 1-methoxy-9,10-bis(phenylethynyl) anthracene, perylene, rubrene, mono and dichloro substituted 9,10-bis (phenylethynyl) anthracene, 5,12-bis(phenylethynyl) tetracene, 9,10-diphenyl anthracene, and 16,17-didecycloxyviolanthrone.

Commercial chemiluminescent systems employed to produce light are normally activated by combining the two components, which are usually in the form of chemical solutions. Typically, these two chemical solutions are referred to as the "oxalate" component and the "activator" component.

The term "peroxide component," as used herein, means a solution of a hydrogen peroxide compound, a hydroperoxide compound, or a peroxide compound in a suitable diluent.

The term "hydrogen peroxide compound" includes (1) hydrogen peroxide and (2) hydrogen peroxide producing compounds.

Hydrogen peroxide is the preferred hydroperoxide and may be employed as a solution of hydrogen peroxide in a solvent or as an anhydrous hydrogen peroxide compound such as sodium perborate, sodium peroxide, and the like. Whenever hydrogen peroxide is contemplated to be employed, any suitable compound may be substituted which will produce hydrogen peroxide. The hydrogen peroxide concentration in the peroxide component may range from about 0.2M to about 15M. Preferably, the concentration ranges from about 1M to about 2M.

The term "chemiluminescent reactant", "chemiluminescently reactive" or "chemiluminescent reactant composition" as used herein, is interpreted to mean a mixture or component thereof which will result in a chemiluminescent reaction when reacted with other necessary reactants in the processes as disclosed herein.

The term "chemiluminescent light emitting plastic" as used herein, means a transparent or translucent resin adapted for the passage of chemically generated light therethrough.

The term "fluorescent compound", as used herein, means a compound which fluoresces in a chemiluminescent reaction, or a compound which produces a fluorescent compound in a chemiluminescent reaction.

The term "chemiluminescent composition", as used herein, means a mixture which will result in chemiluminescence.

The two components are generally kept physically separated prior to activation by a variety of means. Often, a sealed, frangible, glass vial containing one component, or first solution, is housed within an outer flexible container, containing the other component, or second solution. This outer container is sealed to contain both the second solution and the frangible vial. Forces created by intimate contact with the internal vial, e.g. by flexing, cause the vial to rupture, thereby releasing the first solution, allowing the first and second solutions to mix and produce light. Since the object of this type of device is to produce usable light output, the outer vessel is usually composed of a clear or translucent material, such as polyethylene or polypropylene, which permits the light produced by the chemiluminescent system to be transmitted through the vessel walls.

The two-part peroxy-oxalate chemical lighting systems known in the prior art provide practical chemical lighting systems that are useful for a variety of applications. These systems are efficient producers of chemiluminescent light, are storage stable, simple to operate, safe to use, and are capable of being formulated to meet a variety of brightness, color and lifetime requirements. Examples of these prior art chemiluminescent lighting systems can be found in one or more of the following U.S. Pat. Nos. 3,749,679; 3,391,069; 3,974,368; 3,557,233; 3,597,362; 3,775,336; and 3,888,786, which are incorporated herein by reference.

The production of devices capable of emitting light through chemical means is well-known in the art. LIGHT-STICKS, for example, are taught in U.S. Pat. No. 3,539,794, while other configurations have also been the subject of many U.S. Pat. Nos., e.g. 3,749,620; 3,808,414; 3,893,938; 4,635,166; 4,814,949 and 5,121,302, the contents of which are herein incorporated by reference.

The instant invention teaches a chemical light plastic training bullet. It encompasses a plastic outer bullet-shaped casing, which includes one chemiluminescent reactant (either oxalate or activator) in a first end of the bullet, a barrier device, e.g. a plastic disc or the like effective to substantially segregate said one chemiluminescent reactant from a second chemiluminescent reactant placed in a second end of said bullet, and finally a sealing cap.

The design of the barrier device, which is illustrated as, but not limited to a press fit design, is critical to the success of the bullet. Judicious choice of the interference fit of the barrier device determines the functionality of the device. For example, too loose a fit will allow leakage of the two chemical light liquids and substantially shorten shelf life. However, the interference between the barrier device and the side-walls of the bullet can be adjusted for different effects. Specifically, if only a marking round is desired, a significant interference fit is desired (interference of 0.04"-0.06). If a tracing plus marking round is desired, a less significant interference fit is desired (interference of 0.015"-0.039"). If only a tracing round is desired, the less significant interference fit is again selected, in combination with a choice of outer bullet-shaped casing material which is non-frangible.

In practice, the assembled bullet is combined with the propulsion device, e.g. press fit into a casing of the needed caliber, loaded into the weapon, and fired. The primer in the casing propels the bullet from the weapon. For the tracing plus marking or the tracing, only, round, the effect of the rifling lands on the projectile as it moves through the barrel displaces the disk and the spin of the projectile induced by the rifling results in the mixing of the two chemical light liquids. Light results and the bullet emits light as it exits the weapon and travels to its target. For the marking, only, round, the firing action does not displace the disk. The impact of the frangible bullet onto its target allows the disk to free as the plastic bullet deforms from the force of impact. This allows the two chemical light liquids to both mix and to dispense and/or mark the target.

Accordingly, it is an objective of the instant invention to provide a small caliber, non-lethal projectile useful in night-time training exercises.

It is a further objective of the instant invention to provide a nighttime training projectile which produces light by chemiluminescence.

It is yet another objective of the instant invention to provide a projectile which marks a target area with a chemiluminescent composition.

It is a still further objective of the invention to provide a projectile which exhibits at least a tracing functionality attributable to chemiluminescently generated light, in conjunction with a marking function, if desirable.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
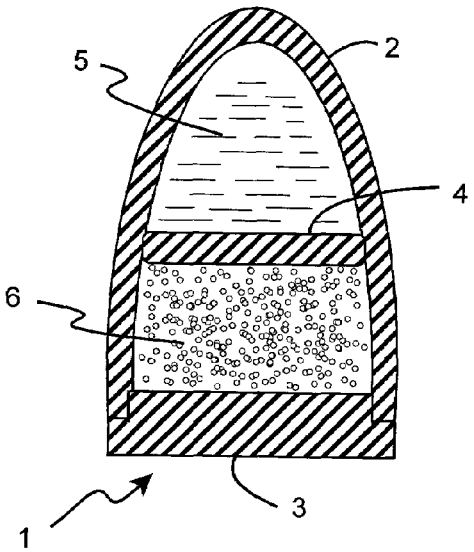
FIG. 1 illustrates a non-frangible, non-tracing projectile which generates light upon impact.

With reference to FIG. 1, a non-frangible, non-tracing projectile 1 is illustrated having a non-frangible light transmitting outer casing 2 adapted for retention of chemiluminescent reactants therein, a sealing cap 3, a barrier device, e.g. a plastic disc or the like 4 having a significant interference fit within the range of about 0.04"-0.06", a first chemiluminescent reactant 5, which is located in a first end of said projectile, and a second chemiluminescent reactant 6 which is located in a second end of said projectile. Upon impact, the barrier device, e.g. a plastic disc or the like, is dislodged, permitting the device of this embodiment to emit chemiluminescent light by transmission through the translucent/transparent outer casing 2. No dispersal of the chemiluminescent reactants occurs, thus only a marking functionality is enabled.

Figure 2:
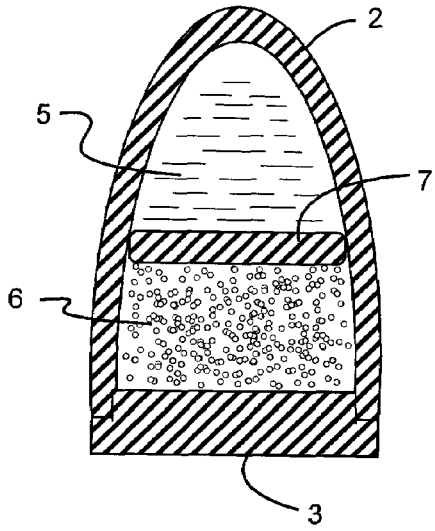
FIG. 2 illustrates a non-frangible projectile which incorporates tracing functionality.

Referring to FIG. 2, a non-frangible projectile, essentially as set forth in FIG. 1 is illustrated, however the barrier device, e.g. a plastic disc or the like 7, is configured with a less significant interference fit within the range of about 0.015"-0.039", thereby permitting some leakage to occur, subsequent to firing, between the said first and second chemiluminescent reactants which permits chemiluminescent light generation in-flight and thereby provides a tracing functionality in addition to the marking functionality.

Figure 3:
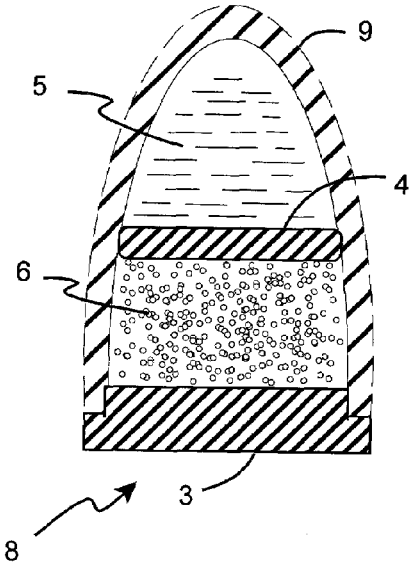
FIG. 3 illustrates a frangible projectile which disperses a chemiluminescent composition upon impact.

Now referring to FIG. 3, a frangible projectile 8 which is essentially identical in structure to that described in FIG. 1 is further illustrated. FIG. 3 differs in that the outer casing 9 is formed from a frangible, but light transmitting material which enables dispersal of the chemiluminescent composition upon impact; thus permitting a larger visible target area to be illuminated, if so desired.

Figure 4:
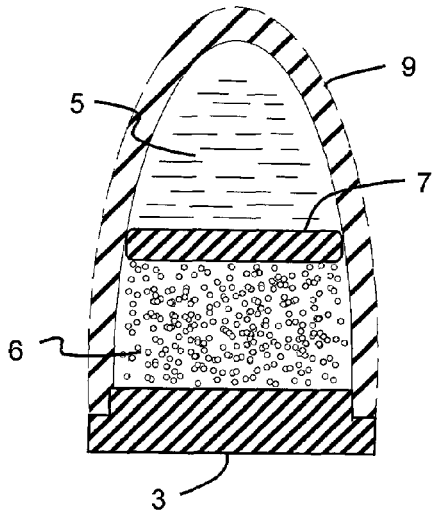
FIG. 4 illustrates a frangible projectile which incorporates a tracing functionality.

Lastly, referring to FIG. 4, a frangible projectile essentially identical to that of FIG. 2 is illustrated. As described supra, this configuration provides a tracing functionality, and further provides dispersal of the chemiluminescent reactants due to the frangible outer casing 9.

Non-limiting examples of the materials useful in construction of the projectiles are:

EXAMPLE 1

A liquid oxalate solution made up of an appropriate amount of an oxalate, e.g. Bis (2,4,5-trichlorophenyl)carbopentoxy oxalate(about 8%-32% depending on solvent) and a fluorescent dye(about 0.1% to 0.5% depending on solvent) chosen from, but not limited to, the anthracene, pentacene, napthacene, napthalene, or perylene dicarboximide families and a solvent that is liquid at room temperature capable of solvating the two prior components. Possible oxalate solvents include, but are not limited to, dibutyl phthalate, butyl benzoate, and ethyl-hexyl diphenyl phosphate. A liquid activator solution made up of hydrogen peroxide (about 1%-8%,real), t-butanol(about 9%-20%), a catalyst such as sodium salicylate, and a solvent that is liquid at room temperature capable of solvating the other ingredients. Possible, activator solvents include, but are not limited, to dimethyl phthalate, triethyl citrate, and ethylene glycol dibenzoate.

EXAMPLE 2

A liquid oxalate solution made up of an appropriate amount of an oxalate, e.g. Bis (2,4,5-trichlorophenyl)carbopentoxy oxalate(about 8%-32% depending on solvent) and a fluorescent dye(about 0.1% to 0.5% depending on solvent) chosen from, but not limited to the anthracene, pentacene, napthacene, napthalene, or perylene dicarboximide families and a solvent that is liquid at room temperature capable of solvating the two prior components. Possible oxalate solvents include, but are not limited to, dibutyl phthalate, butyl benzoate, and ethyl-hexyl diphenyl phosphate. A solid activator solution made up of hydrogen peroxide (about 1%-8%,real), t-butanol(about 9%-20%), a catalyst such as sodium salicylate, and a solvent that is solid at room temperature capable of solvating the other ingredients when heated above it's melting point. Possible activator solvents include, but are not limited to, trimethyl citrate and glycerol tribenzoate.

EXAMPLE 3

A solid oxalate solution made up of an appropriate amount of an oxalate, e.g. Bis (2,4,5-trichlorophenyl) carbopentoxy oxalate(about 8%-32% depending on solvent) and a fluorescent dye(about 0.1% to 0.5% depending on solvent) chosen from, but not limited to, the anthracene, pentacene, napthacene, napthalene, or perylene dicarboximide families and a solvent that is liquid at room temperature capable of solvating the two prior components and been rendered "solid" by mixing into the solvent sufficient polyvinyl chloride to make the combination a dry powder. Possible oxalate solvents include, but are not limited to, dibutyl phthalate, butyl benzoate, and ethyl-hexyl diphenyl phosphate. A liquid activator solution made up of hydrogen peroxide (about 1%-8%, real), t-butanol(about 9%-20%), a catalyst such as sodium salicylate, and a solvent that is liquid at room temperature capable of solvating the other ingredients. Possible activator solvents include, but are not limited to, dimethyl phthalate, triethyl citrate, and ethylene glycol dibenzoate.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A chemiluminescent light emitting plastic training projectile comprising:

an outer casing adapted to permit the passage of light therethrough, said outer casing having a first end and a second end and a continuous sidewall therebetween, said sidewall having an inner surface and an outer surface;

first and second chemiluminescent reactants placed within said outer casing;

a sealing cap adapted to sealingly engage said outer casing adjacent said second end thereof; and a barrier device adapted to be positioned within said outer casing to substantially segregate said first and second chemiluminescent reactants said barrier device is constructed and arranged to have an interference fit with said inner surface of said continuous sidewall, said interference fit within the range of about 0.015"-0.06";

whereby sizing of said interference fit within said range enables said projectile to incorporate tracing, marking or combined tracing and marking functionality.

2. The chemiluminescent light emitting plastic training projectile in accordance with claim 1 wherein:

said outer casing is frangible;

whereby upon impact said projectile disperses a chemiluminescent composition.

3. The chemiluminescent light emitting plastic training projectile in accordance with claim 1 wherein:

said outer casing is non-frangible;

whereby upon impact a chemiluminescent composition is retained within said projectile.

4. The chemiluminescent light emitting plastic training projectile in accordance with claim 1 wherein:

said interference fit is within the range of about 0.015"-0.039";

whereby some leakage occurs between said first and second chemiluminescent reactants subsequent to firing, thereby permitting chemiluminescent light generation in-flight which provides tracing functionality.

5. The chemiluminescent light emitting plastic training projectile in accordance with claim 4 wherein:

said outer casing is frangible;

whereby upon impact said projectile disperses a chemiluminescent composition.

6. The chemiluminescent light emitting plastic training projectile in accordance with claim 4 wherein:

said outer casing is non-frangible;

whereby upon impact a chemiluminescent composition is retained within said projectile.

7. The chemiluminescent light emitting plastic training projectile in accordance with claim 1 wherein: said interference fit is within the range of about 0.04"-0.06;

whereby leakage is prevented between said first and second chemiluminescent reactants thereby preventing in-flight chemiluminescent light generation prior to impact and a marking functionality subsequent thereto.

8. The chemiluminescent light emitting plastic training projectile in accordance with claim 7 wherein:

said outer casing is frangible;

whereby upon impact said projectile disperses a chemiluminescent composition.

9. The chemiluminescent light emitting plastic training projectile in accordance with claim 5 wherein:

said outer casing is non-frangible;

whereby upon impact a chemiluminescent composition is retained within said projectile.

* * * * *